US007011606B2

(12) United States Patent
Zngf et al.

(10) Patent No.: US 7,011,606 B2
(45) Date of Patent: Mar. 14, 2006

(54) SUCCESSIVE SLIDING EXERCISER

(76) Inventors: Frank Zngf, 11F.-1, No. 380, Defu Rd., South District, Taichung City 402 (TW); Stephen Lai, No. 4, Alley 12, Lane 115, Shusiao Rd., Taiping City, Taichung County 411 (TW)

( * ) Notice: Subject to any disclaimer, the term of this patent is extended or adjusted under 35 U.S.C. 154(b) by 62 days.

(21) Appl. No.: 10/853,853

(22) Filed: May 25, 2004

(65) Prior Publication Data

US 2005/0266962 A1 Dec. 1, 2005

(51) Int. Cl.
*A63B 7/00* (2006.01)

(52) U.S. Cl. ..... 482/37; 482/51

(58) Field of Classification Search ..... 482/51, 482/35–37, 69, 148; 472/116, 137; 104/62, 104/106

See application file for complete search history.

(56) References Cited

U.S. PATENT DOCUMENTS 3,090,617 A * 5/1963 Hjelte et al. ..... 482/143
4,497,484 A * 2/1985 West ..... 482/35
5,468,199 A * 11/1995 Keeler et al. ..... 482/35
5,931,100 A * 8/1999 Sutton et al. ..... 104/53
6,503,174 B1 * 1/2003 Mantooth ..... 482/37
6,855,064 B1 * 2/2005 Sundahl ..... 472/116

* cited by examiner

*Primary Examiner*—Stephen R. Crow
(74) *Attorney, Agent, or Firm*—Alan D. Kamrath; Nikolai & Mersereau, P.A.

(57) ABSTRACT

A successive sliding exerciser includes a beam, a sliding part which is installed in the beam and is able to slide between two ends of the beam, and two upholders to support the beam on two ends. Each upholder has a stepping slot with two platforms of different height. When using this exerciser, a user grabs the sliding part and slides from the higher end to the lower end. Upon reaching the lower end, the beam is lifted backward and is placed on the higher platform, the other end automatically falls to the lower platform. One end to the other, the two ends of the beam switch their positions of lower end and higher end. Therefore, the user is able to slide back, and the exercising action can continue back and forth.

4 Claims, 6 Drawing Sheets

SUCCESSIVE SLIDING EXERCISER

BACKGROUND OF THE INVENTION

1. Field of the Invention

The present invention relates to an exerciser which is allowed to slide on with gravity effect, and more particularly to an apparatus used to aid reinforcing user's muscle strength and to have fun.

2. Description of Related Art

In some playgrounds, a kind of exerciser is commonly seen. Under a horizontal beam of such an exerciser, a user holds on to a handgrip of a sliding part slidably mounted in the beam and hangs on to slide. The user needs to produce propelling force for the move by his/her body impacting or twisting. The move is strenuous and bumpy and the fun is diminishing as the user is worn out easily.

There is also another kind of sliding exerciser, which includes a beam or a cable with its two ends fixed on different heights. A user holds onto a sliding part which is able to slide along the beam or the cable. With gravity effect, the user can slide from the higher end to the lower end. On arriving the lower end, the user can not go on sliding unless he/she pulls the sliding part back to the higher end, the fun of sliding is interrupted constantly.

With this exerciser of a simple innovative design and a corresponding method for using it, the drawbacks as bumpy sliding and corresponding method for using it, the drawbacks as bumpy sliding and sliding interruption will be overcome gracefully. With this exerciser, a user is able to change the inclining direction of the beam with a simple movement, and two-way successive sliding can be performed. The objective of increasing smooth sliding and non-interrupted fun of exercising will be achieved.

The present invention has arisen to mitigate and/or obviate the disadvantages of the conventional sliding exercisers.

SUMMARY OF THE INVENTION

The main objective of the present invention is to provide a successive sliding exerciser with which a user can perform successive back and forth sliding along a beam with gravity effect. Upon a user sliding from the higher end to the lower end of the beam, the inclining direction of the beam can be easily reversed such that the user can slide, subsequently, in a reverse direction. The present invention thus will allow the user to slide smoothly with two way successive moves.

To achieve the objective, the successive sliding exerciser in accordance with the present invention comprises a traverse beam with a sliding track built inside, a sliding part, fitted on the track, which includes a hand grip for the user to hold on to suspend his body and is slidable between two ends of the beam. Additionally, two upholders, placed in two sides, support the beam movable on the two ends. Each upholder has a stepping slot with two platforms of different height. The length of the beam is equal to the distance from the higher platform on one end to the lower platform on the other end. When using this exerciser, the user grabs the sliding part and slides from the higher end to the lower end. Upon reaching the lower end, the beam of this end is lifted up backward and is placed on the higher platform, the other end of the beam will automatically fall to the lower platform. One end to the other, the two ends switch their positions of lower end and higher end. Therefore, the user is able to slide back, and the sliding exercising action can continue back and forth.

Further benefits and advantages of the present invention will become apparent after a careful reading of the detailed description with appropriate reference to the accompanying drawings.

DETAILED DESCRIPTION OF THE INVENTION

Figure 1:
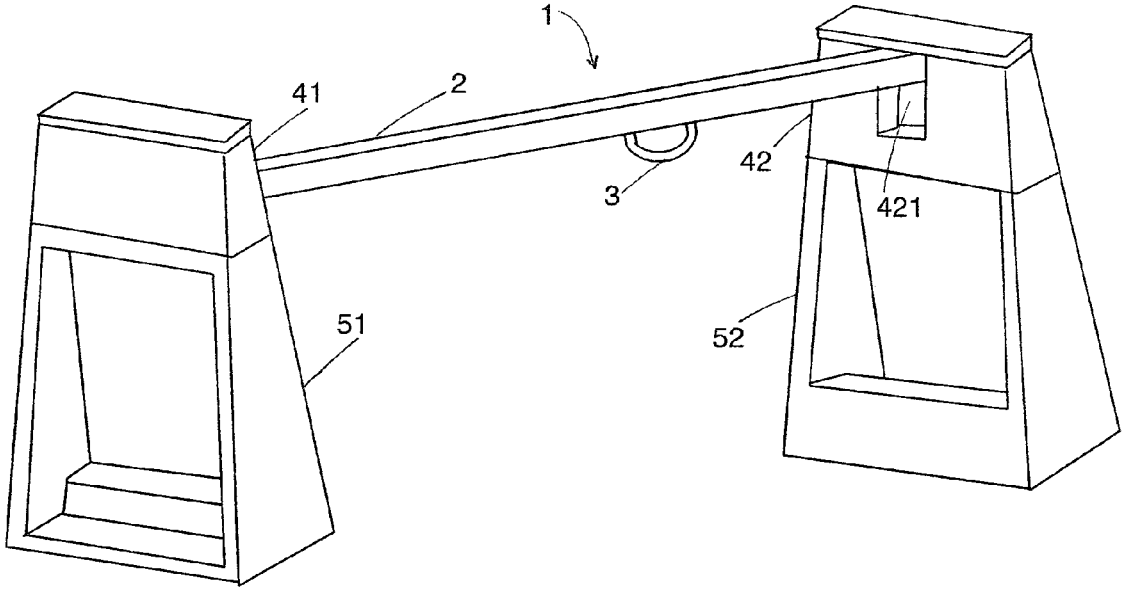
FIG. 1 is a perspective view of a successive sliding exerciser in accordance with the present invention.
Figure 2:
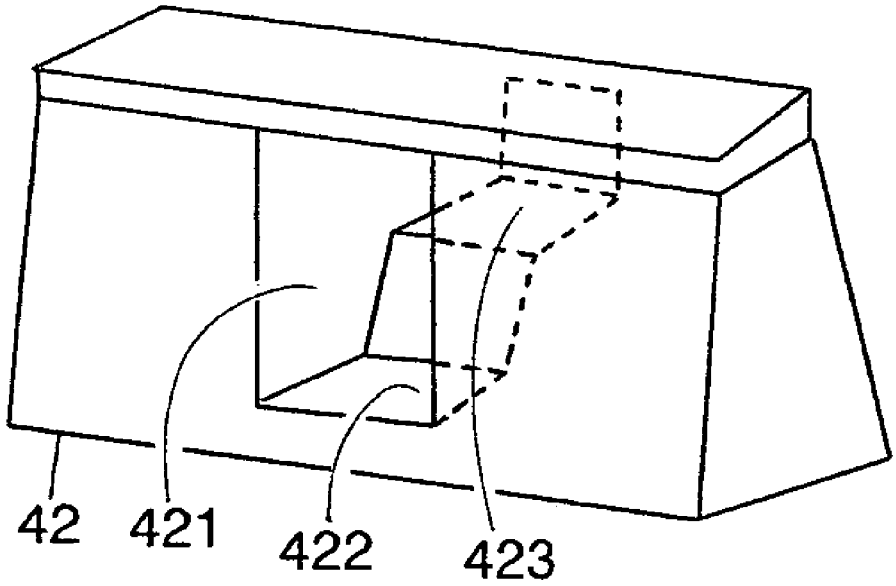
FIG. 2 is a perspective view of an upholder of the successive sliding exerciser in FIG. 1.
Figure 3:
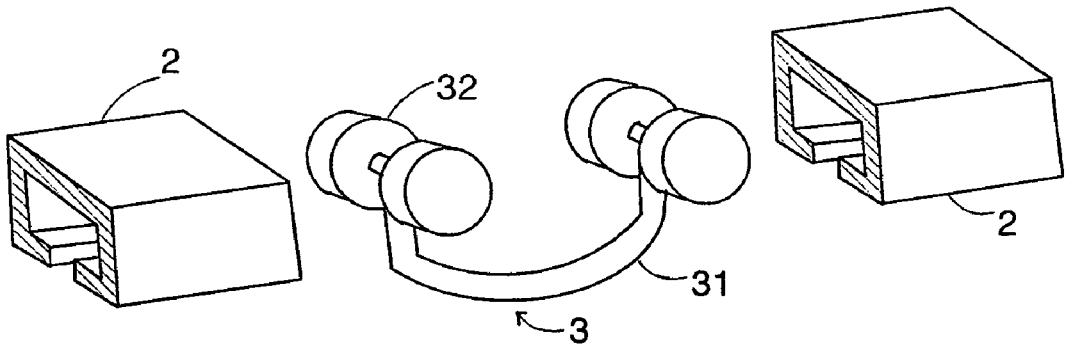
FIG. 3 is a perspective view of a sliding part and a beam of the successive sliding exerciser, wherein the beam is in cross-section.
Figure 4:
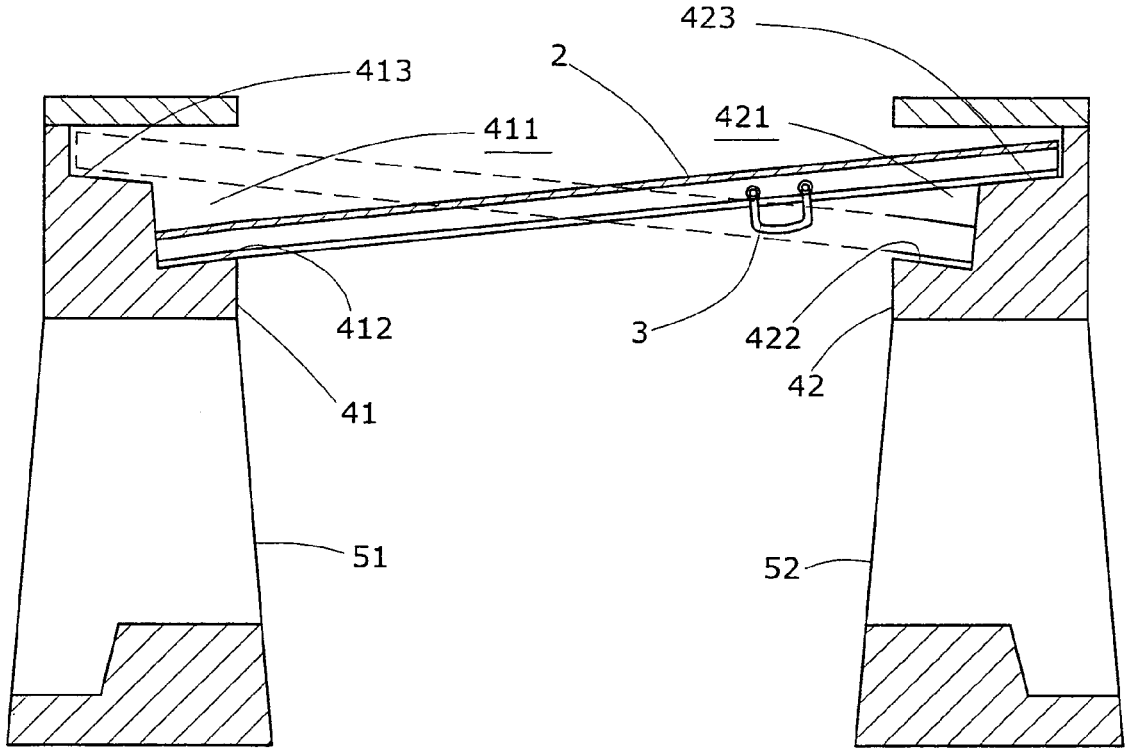
FIG. 4 is a cross-sectional view of the successive sliding exerciser in FIG. 1.

Referring to FIGS. 1 to 4, the successive sliding exerciser (10) in accordance with the present invention comprises a beam (2), a sliding part (3), a first and a second upholders (41, 42), and a first and a second supporting frames (51, 52). The first and second supporting frames (51, 52) are placed on the ground separating from each other in a designated distance. Each upholder (41/42) is fixed on a top of a corresponding one of the first and the second supporting frames (51, 52). The sliding part (3) is slidably fitted on the tracks (not numbered) that are formed on two opposite sides in the beam (2). As shown in FIG. 3, the sliding part (3) includes a handgrip (31) for a user to hold to suspend himself/herself and several roller wheels (32) to allow the sliding part (3) slide on the tracks of the beam (2). Referring to FIG. 4, the first and the second upholders (41, 42) are placed in two sides for supporting the beam (2) detachable from the ends. The first upholder (41) has a first stepping slot (411) defined therein and the second upholder (42) has second stepping slot (421) defined therein. The second stepping slot (421) is shown in FIG. 2 for further clarification. Each stepping slot (411/421) includes two platforms respectively in a lower and higher level positions. As shown in FIG. 4, there are lower platforms (412, 422) and higher platforms (413, 423), and the length of the beam is about the distance between a higher platform in a stepping slot to the lower platform in the other stepping slot, i.e., the length of the beam is the distance of the right higher platform (423) to the left lower platform (412), or the left higher platform (413) to the right lower platform (422).

Referring to FIG. 4, using the exerciser, the user holds onto the hand grip of the sliding part (3), and slides from the right higher end (423) of the beam to the left lower end (412) of the beam driven by gravity force. Having reached the left side of the exerciser, the user can lift this beam end on the lower platform (412) up and backward to the higher platform, the other end of the beam will fall onto the lower platform (422) and the slidable direction of the beam is thus reversed. The present position of the beam is shown as the dotted lines in FIG. 4. Consequently, the user can hold onto the sliding part (3) in the left side to slide back to the right side of the exerciser. Such movements can be repeated back and forth successively that the fun of sliding will not be interrupted.

Figure 5:
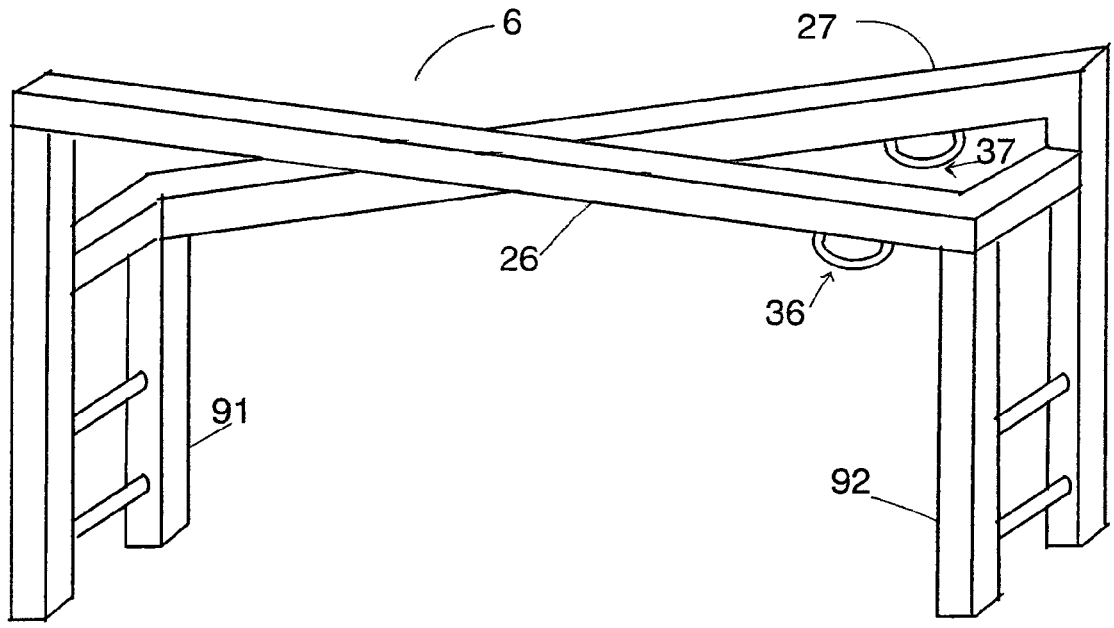
FIG. 5 is a perspective view of a second embodiment of the successive sliding exerciser in accordance with the present invention.
Figure 6:
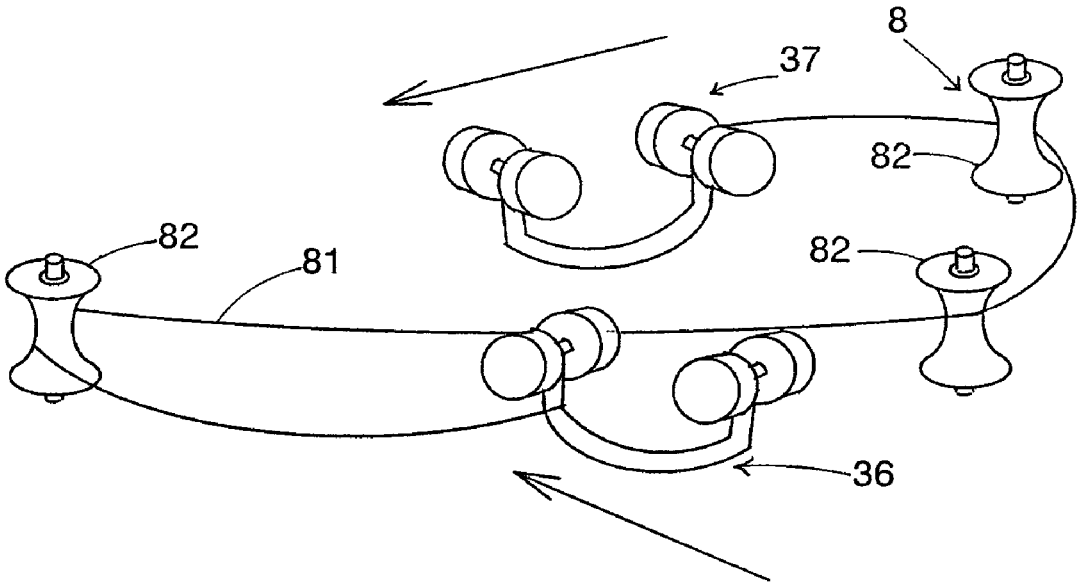
FIG. 6 is a perspective view of a linking set and two sliding parts of the successive sliding exerciser in FIG. 5.

Referring to FIG. 5, another embodiment of the present invention is two-track type successive sliding exerciser (6), such exerciser mainly comprises two beams (26, 27), two sliding part (36, 37), a cable linking set (8) (see FIG. 6) and two supporting frames (91, 92). The two beams (26, 27) are fixed on frames side by side, each beam is mounted in with a sliding part (36, 37) which is slidable between two ends of its corresponding beam (26, 27). Two frames are constructed to the two ends of the beams in order to fix and to support the beams. The two ends of each beam are fixed on different altitude levels and the inclination directions for both beams are opposite to each other. Connecting the two sliding parts (36, 37), a linking set (8) for force transmission is mounted in the beams. As shown in FIG. 6, a cable linking set (8) includes a cable (81) and its two ends are tied to the two sliding parts (36, 37). Between the sliding parts, the cable passes around three idle wheels (82) such that the move of one sliding part can draw the other one to move simultaneously. If a sliding part (37) is held by a user and is pulled down sliding with gravity effect, the other sliding part (36) on the other beam will move in the same direction but up sliding. As shown in FIG. 5, a user standing at the right end of the exerciser, holds onto the sliding part (37) at the higher end of the back beam (27), and slides along this beam (27) to the left lower end. The other sliding part (36) at the other beam (26), due to the drawing force transmitted by the cable, is pulled in parallel to the left side, but the higher end. Upon reaching the other end, i.e., the left end, the user can switch to the other beam (26), and slide back in a reverse direction to the right side. At the right side, the user can repeat the actions similar to those at the left side but in an opposite way. The back and forth sliding then can be repeated again and again.

Even though numerous characteristics and advantages of the present invention have been set forth in the foregoing description, together with details of the structure and function of the invention, the disclosure is illustrative only, and to the full extent indicated by the broad general meaning of the terms in which the appended claims are expressed.

The present invention may be embodied in other specific forms without departing the principles or essential attributes even changes of the disclosure may be made in detail, especially in matters of shape, size, and arrangement of parts. Thereof and accordingly, reference should be made to the appended claims rather than to the foregoing description as indicating the scope of the invention.

What is claimed is:

1. A successive sliding exerciser comprising:

a beam built in with a sliding track;

a sliding part slidably mounted on the track of the beam and movably between two opposite ends of the beam; and two upholders supporting the beam on the two opposite ends of the beam, wherein each upholder has a stepping slot with two platforms of different height, the beam is movable, and the length of beam is made equal to a distance from the higher platform on one upholder to the lower platform on the other upholder;

whereby the user grabs the sliding part and slides from the higher end to the lower end of the beam, upon reaching the lower end, the end of the beam is lifted up backward and is placed on the higher platform of the upholder, the other end automatically falls to the lower platform of the opposite upholder, one end to the other, the two opposite ends of the beam switch their positions of lower end and higher ends, therefore, the user is able to slide back, and the exercising action can continue back and forth in between the two opposite ends of the beam.

2. The successive sliding exerciser as claimed in claim 1, wherein the sliding part comprises a plurality of roller wheels that enable the sliding part to slide on the track of the beam, and a loading part, which makes is possible for a person to hang upon, to be seated or to stand on.

3. A successive sliding exerciser comprising:

two beams constructed side by side, each built in with a sliding track;

two sliding parts, each slidably mounted, respectively, on the sliding track of a corresponding one of the two beams and movable between two opposite ends of each of the two beams;

two supporting frames supporting the two beams by fixing the ends on both sides of each of the two supporting frames, wherein two opposite ends of each of the two beams are on different levels of altitude and the two beams are mounted side by side with opposite inclination directions, and the two sliding parts are fitted against the two beams side by side; and a linking set including a cable and a plurality of pulleys linking said two sliding parts, wherein one of said sliding part is pulled to move, the other sliding part is drawn to move simultaneously in the same direction;

whereby on one end of said successive sliding exerciser, a user grabs a said sliding part which is on the higher end of a said beam, the user is able to slide from the higher end to the lower end by gravity, due to the drawn force of said linking set, said sliding part on the other said beam will move side by side, but from the lower end to the higher end; as the user slides by gravity and reaches the lower end of one said beam, the other said sliding part on the other said beam will be ready on the higher end side by side, therefore the user can displace him/herself to grab that said other sliding part and slide back.

4. The successive sliding exerciser as claimed in claim 3, wherein the sliding part comprises a plurality of roller wheels that enable the sliding part to slide on the track of the beam, and a loading part, which makes is possible for a person to hang upon, to be seated or to stand on.

* * * * *